US009212039B1

(12) United States Patent
Reidy et al.

(10) Patent No.: US 9,212,039 B1
(45) Date of Patent: Dec. 15, 2015

(54) BODY SCRUB BRUSH WITH LIQUID SOAP DISPENSER

(76) Inventors: James Reidy, Lake Worth, FL (US); Carolyn Keane, Lake Worth, FL (US)

( * ) Notice: Subject to any disclaimer, the term of this patent is extended or adjusted under 35 U.S.C. 154(b) by 582 days.

(21) Appl. No.: 13/571,940

(22) Filed: Aug. 10, 2012

Related U.S. Application Data

(60) Provisional application No. 61/521,894, filed on Aug. 10, 2011.

(51) Int. Cl.

| | |
|---|---|
| ***B43K 23/008*** | (2006.01) |
| ***A45D 34/04*** | (2006.01) |
| ***A46B 13/02*** | (2006.01) |
| ***B67D 1/07*** | (2006.01) |
| ***A47K 7/03*** | (2006.01) |
| ***A46B 5/00*** | (2006.01) |
| ***A46B 11/00*** | (2006.01) |
| ***A46B 15/00*** | (2006.01) |
| ***A47L 13/17*** | (2006.01) |
| ***A47K 5/12*** | (2006.01) |

(52) U.S. Cl.
CPC ..... *B67D 1/07* (2013.01); *A46B 5/0008* (2013.01); *A46B 5/0075* (2013.01); *A46B 5/0095* (2013.01); *A46B 11/0013* (2013.01); *A46B 11/0079* (2013.01); *A46B 15/0055* (2013.01); *A47K 5/12* (2013.01); *A47K 5/1207* (2013.01); *A47K 7/03* (2013.01); *A47L 13/17* (2013.01)

(58) Field of Classification Search
USPC ..... 401/6, 187, 146, 205, 276, 270, 184, 401/278; 222/192, 385, 481.5; 15/104.94, 15/104
See application file for complete search history.

(56) References Cited

U.S. PATENT DOCUMENTS

| | | | | |
|---|---|---|---|---|
| 5,944,032 | A * | 8/1999 | Masterson | 132/290 |
| 6,983,866 | B2 * | 1/2006 | Smart et al. | 222/192 |
| 7,040,830 | B2 * | 5/2006 | Kliegman et al. | 401/290 |
| 7,682,097 | B2 * | 3/2010 | Knopow et al. | 401/136 |

* cited by examiner

*Primary Examiner* — Paul R Durand
*Assistant Examiner* — Thomas M Abebe
(74) *Attorney, Agent, or Firm* — Nancy J. Flint, Esq.; Nancy J. Flint, Attorney At Law, P.A.

(57) ABSTRACT

A body scrub brush with an integrated liquid soap dispenser that eliminates the need to maintain a bottle or bar of soap in the bathing area is disclosed.

19 Claims, 9 Drawing Sheets

BODY SCRUB BRUSH WITH LIQUID SOAP DISPENSER

REFERENCE TO RELATED APPLICATION

This application claims the benefit of U.S. Provisional Patent Application No. 61/521,894, filed Aug. 10, 2011 and titled Body Scrub Brush With Liquid Soap Dispenser, the contents of which are incorporated herein by reference in their entirety.

FIELD OF THE INVENTION

The invention is directed to a body scrub brush with an integrated liquid soap dispenser that eliminates the need to maintain a bottle or bar of soap in the bathing area.

BACKGROUND OF THE INVENTION

Historically bars of soap have been used in personal cleansing dating back to 2800 BC in Ancient Babylon. An alternative to bar soap is liquid soap, also called bath or shower gel. Liquid soap was actually first patented in the United States by William Shepphard of New York, who was granted U.S. Pat. No. 49,561 for his "Improved Liquid Soap" on Aug. 22, 1865 for his discovery that a small amount of conventional soap could be mixed with large amounts of hartshorn to create a soap with a consistency of molasses. It was not until the $20^{th}$ century, however, that liquid soap became a household item.

While both products are used today in bathing, there are pros and cons to each. Bar soap, when left in the shower or bath, tends to become "slimy" and leave a layer of scum. Liquid soap tends to be overused by bathers. Regardless, liquid soap has become very popular.

Liquid soap is often used by applying it to some type of applicator, such as a pouf or a loofah. The bather creates a lather by mixing the liquid soap with water and then bathes by scrubbing his or her body with the foamy pouf or loofah. In comparison, bar soap is typically used directly by the bather on the skin, or else can be used to "lather up" a terry wash cloth which is then used on the skin.

One of the common problems that bathers face is washing the back. Obviously most bathers cannot reach their back with either a bar of soap, a wash cloth or a pouf or loofah. To remedy this problem, a number of retailers sell poufs or loofahs on extension arms. The bather can place soap on the pouf or loofah, create a lather and then reach his or her back with the lathered pouf or loofah. It is difficult to tell when the lather on the pouf or loofah has washed off, and the bather must repeatedly place soap on the pouf or loofah and create a lather to make sure that the entire back is washed with soap.

SUMMARY OF THE INVENTION

The invention is directed to a body scrub brush comprising a handle having a hollow interior cavity configured for containing liquid soap; a head comprising a scrubbing attachment receiver wherein the head further comprises one or more outlet holes located substantially in the center of the scrubbing attachment receiver, each sealed with an elastomeric seal having at least one orifice; a channel between the hollow interior cavity of the handle and each outlet hole; and an elastomeric button situated on the handle that is configured to pump liquid soap through the channel and through the outlet holes. The head is configured to receive a variety of scrubbing attachments, including but not limited to poufs; loofahs; and wash cloths. The handle has a resealable opening through which liquid soap can be transferred into the hollow interior cavity. In one embodiment, the elastomeric button comprises the resealable opening. The scrub brush of the invention enables soap dispensing in the bath or shower without the need to maintain a bottle or bar of soap in the bathing area. Further, the type and/or fragrance of the liquid soap placed in the hollow interior cavity can be varied at each refill. Even further, liquid soaps of varying types and/or fragrances can be mixed in the hollow interior cavity of the handle.

DESCRIPTION OF THE DRAWINGS

The invention will be described with reference to the accompanying drawings.

DETAILED DESCRIPTION OF THE INVENTION

Figure 1A:
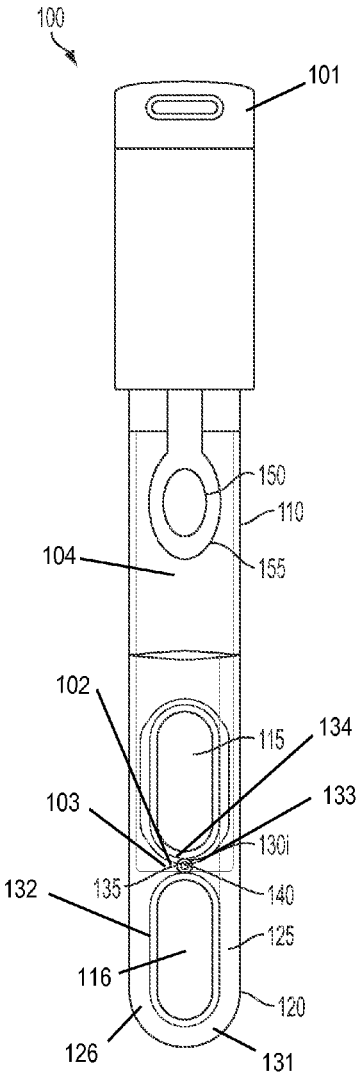
FIG. 1A depicts a top view of a body scrub brush according to one embodiment of the invention.

The invention is directed to a body scrub brush comprising a handle having a hollow interior cavity configured for containing liquid soap; a head comprising a scrubbing attachment receiver wherein the head further comprises one or more outlet holes located substantially in the center of the scrubbing attachment receiver, each sealed with an elastomeric seal having at least one orifice; a channel between the hollow interior cavity of the handle and each outlet hole; and an elastomeric button situated on the handle that is configured to pump liquid soap through the channel and through the outlet holes. The head is configured to receive a variety of scrubbing attachments, including but not limited to poufs; loofahs; and wash cloths. The handle has a resealable opening through which liquid soap can be transferred into the hollow interior cavity. In one embodiment, the elastomeric button comprises the resealable opening. The scrub brush of the invention enables soap dispensing in the bath or shower without the need to maintain a bottle or bar of soap in the bathing area. Further, the type and/or fragrance of the liquid soap placed in the hollow interior cavity can be varied at each refill. Even further, liquid soaps of varying types and/or fragrances can be mixed in the hollow interior cavity of the handle.

According to one embodiment of the invention, the body scrub brush comprises a handle having a hollow interior cavity configured for containing liquid soap, and a resealable opening through which liquid soap can be transferred into the hollow interior cavity. The handle may be made of any material, including plastic, metal or wood. The handle has a distal end, a proximal end, a front side and a back side. The depth of the device is the distance between the interior walls of the front side and the back side. The resealable opening may be disposed at the distal end of the handle, or disposed on either the front side or the back side, and may comprise an opening having male threads, which can be mated with a removable cap comprising female threads. The resealable opening allows liquid soap to be poured into the hollow interior cavity of the handle. The handle further comprises an elastomeric button disposed on either the front side or the back side that, when pressed from the exterior by the user, applies a force into the hollow interior cavity of the handle, causing the liquid soap to flow. The elastomeric button comprises a lip which mates with a shoulder in the opening in the handle.

In one embodiment, the elastomeric button comprises the resealable opening. The elastomeric button can be removed from the handle by pulling on the elastomeric button from the exterior, and replaced by lining up the lip of the elastomeric button with the shoulder of the opening and applying pressure until the lip mates with the shoulder. In one embodiment, the elastomeric button comprises a first tab that can be grasped and pulled to remove the elastomeric button from the opening. In one embodiment, the elastomeric button comprises a second tab that attaches the elastomeric button to the handle so that it cannot be separated from the handle.

In one embodiment, the handle further comprises a diverter located in the hollow interior cavity substantially opposite the elastomeric button. The diverter comprises a solid exterior partition that can be tapered in width and height from wider to narrower in the direction of the distal end of the handle to the proximate end of the handle. In one embodiment, the diverter extends only partially into the hollow interior cavity of the handle. When the elastomeric button is pressed such that force is applied to liquid soap in the hollow interior cavity of the handle, the diverter is configured to divert the flow of the liquid soap toward the proximate end of the handle.

The distal end of the handle may be configured for easy gripping by the user. The distal end may be covered with a surface that is easy to grasp when the handle is wet and covered with lather. The distal end may comprise an opening or hook from which the body scrub brush can be hung when not in use while bathing.

The handle may be curved to accommodate the shape of the human back. The handle may be extendible for adjustment to various body sizes.

The proximate end of the handle is enclosed by a top face, where the top face comprises two outlets disposed substantially at opposite outer edges of the top face.

The head of the body scrub brush comprises a distal end comprising a base face, a proximal end comprising a top face, a hollow interior cavity, a front side and a back side. The head of the body scrub brush further comprises a contiguous channel disposed within the hollow interior cavity of the head. The channel comprises two legs and one connector, wherein each leg comprises one open end and connects to the connector at the other end to form a U-shape or rectangular-shape. The base face of the distal end of the head of the body scrub brush mates to the top face of the proximal end of the handle, and each of the two outlets of the legs of the channel mates with one of the outlets that are disposed on the top face of the distal end of the handle.

In one embodiment, the handle and the head comprise a unitary piece having a single hollow interior cavity. In this embodiment, a divider is disposed in the hollow interior cavity between the handle and the head, wherein the divider comprises two outlets that mate with the outlets of the legs of the channel. Further in this embodiment, the divider mates with the interior walls of the hollow interior cavity such that no liquid soap can travel through the hollow interior cavity from the handle into the head except through the channel.

The channel further comprises one or more outlet holes disposed in the connector between the two legs. One outlet hole provides an outlet to either the front side of the head and the other outlet hole, if present, provides an outlet to the opposite side of the head. Each outlet hole comprises an elastomeric seal, wherein each elastomeric seal comprises an orifice, slit, cross-hairs slit or other outlet from the channel to the exterior of the head. The elastomeric seal is configured to retain liquid within the channel when at atmospheric pressure, but to allow liquid to flow through the orifice, slit, cross-hairs slit or other outlet when the pressure within the interior of the channel is increased above atmospheric pressure.

The head of the body scrub brush further comprises one or more scrubbing attachment receivers. In one embodiment, the scrubbing attachment receivers each comprise a cavity that passes through the head from the front side to the back side. In one embodiment, the head comprises a single scrubbing attachment receiver wherein the cavity is disposed substantially in the bottom half of the head. In one embodiment, the head comprises two scrubbing attachment receivers wherein the first cavity is disposed substantially in the distal end of the head and the second cavity is disposed in the proximal end of the head. A scrubbing attachment can be extended through each of the cavities to provide a scrubbing surface.

The outlet holes in the channel are disposed such that a scrubbing attachment that is disposed in one or more of the scrubbing attachment receivers is located substantially proximate to the orifice, slit, cross-hairs slit or other outlet.

In one embodiment, the width of the handle is approximately 1½ inches; the length of the body scrub brush is approximately 16 inches; and the length of the top half of the handle plus the head is approximately 11¾ inches.

In operation, a user opens the resealable opening and pours liquid soap into the hollow interior cavity of the handle. One or more scrubbing attachments, for example two poufs, are disposed in each of two scrubbing attachment receivers in the head. The user presses one or more times on the elastomeric button in the handle, forcing the liquid soap to move across the diverter and up toward the proximal end of the head. The liquid soap passes into the two legs of the channel of the head, and then into the connector and through the orifices, slits, cross-hair slits or other outlets of the channel. The liquid soap passes into the scrubbing attachment where it forms lather during bathing. The user can operate the body scrub brush while scrubbing any part of his or her body, including his or her back. Further, the user can increase the amount of liquid soap that reaches the scrubbing attachment by pressing the elastomeric seal on the handle while scrubbing his or her back.

In one embodiment, the body scrub brush comprises a hollow interior wherein the cross sectional surface area of the hollow interior proximate the elastomeric button is narrower than the cross sectional surface area of the hollow interior of the body at either the proximal end or the distal end of the handle.

In one embodiment, the cross sectional surface area of the hollow interior of the body of the handle gradually decreases starting from the proximal end of the handle in the direction of the elastomeric button and then gradually increases from the elastomeric button to the distal end of the handle.

In one embodiment, the cross sectional surface area of the hollow interior is substantially constant from the proximal end of the handle to a point substantially proximate the elastomeric button, wherein the cross sectional surface area of the hollow interior decreases starting from the point substantially proximate the elastomeric button to the distal end of the handle.

Turning to the figures, FIG. 1A depicts a top view of a body scrub brush according to one embodiment of the invention. Body scrub brush 100 comprises a handle 110 having a first hollow interior cavity 115 configured for containing liquid soap (not shown); a head 120 comprising a scrubbing attachment receiver 125 and a second hollow interior cavity 116 wherein the head 120 further comprises one or more outlet holes $\mathbf{130}_i$ located substantially in the center of the scrubbing attachment receiver 125, where each outlet hole $\mathbf{130}_i$ is sealed with an elastomeric seal 135 having at least one orifice 140; a channel 145 between the first hollow interior cavity 115 of the handle 110 and the second hollow interior cavity leading to each outlet hole 130; and an elastomeric button 150 situated on the handle 110 that is configured to pump liquid soap (not shown) through the channel 145 and through the outlet holes $\mathbf{130}_i$. The handle 110 has a resealable opening 155 through which liquid soap (not shown) can be transferred into the hollow interior cavity 115. In one embodiment, the elastomeric button 150 comprises the resealable opening. Handle 110 comprises first distal end 101, first proximal end 102 enclosed by first top face 103. Head 120 comprises second distal end 133 enclosed by base face 134, second proximal end 131 enclosed by second top face 132 and second front side 126 and second back side, a contiguous channel disposed in the second distal end, wherein the contiguous channel comprises two legs and one connector, wherein each leg comprises one open end, wherein further the channel comprises one or more outlet holes disposed between the two legs, wherein each outlet hole comprises an elastomeric seal having at least one orifice, slit, cross-hair slit or other outlet from the channel to the exterior of the head, and one or more scrubbing attachment receivers configured to mate with one or more scrubbing attachments, each having a scrubbing surface.

Figure 1B:
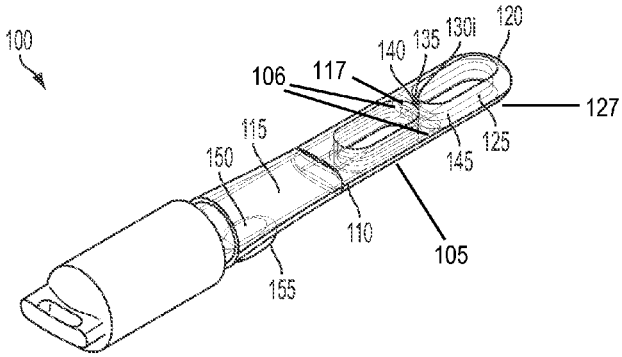
FIG. 1B depicts a top perspective view of the body scrub brush of FIG. 1A.

FIG. 1B depicts a top perspective view of the body scrub brush of FIG. 1A. In one embodiment, a divider 117 is disposed between the first hollow interior cavity 115 and second hollow interior cavity 116. Handle 110 comprises first back side 105 and one or more outlet holes 106.

Figure 1C:
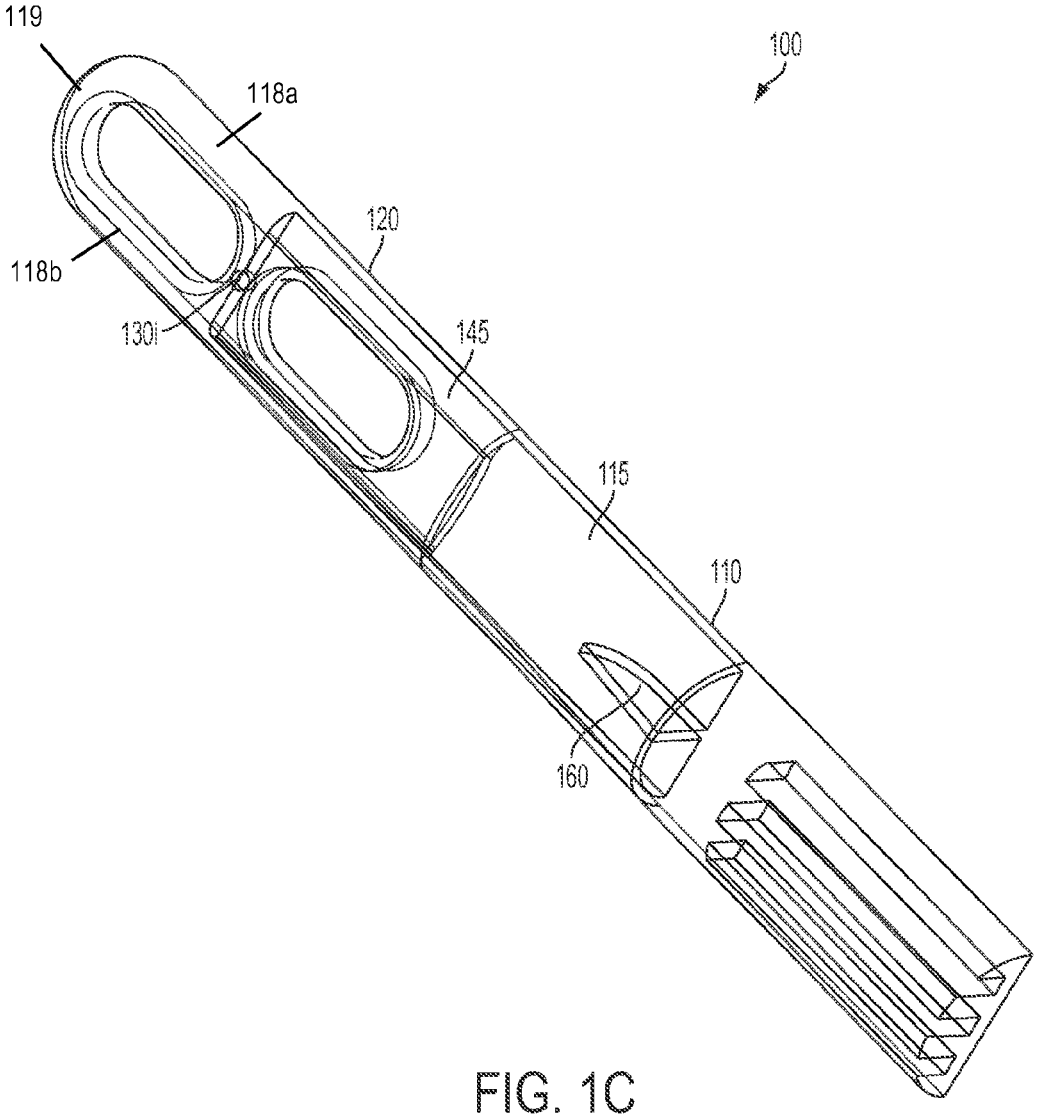
FIG. 1C a body scrub brush according to one embodiment of the invention.

FIG. 1C depicts the body scrub brush 100 according to FIG. 1 wherein the handle 110 further comprises a diverter 160 located in the hollow interior cavity 115 substantially opposite the elastomeric button 155 (not shown). The diverter 160 comprises a solid exterior partition that can be tapered in width and height from wider to narrower in the direction of the distal end of the handle to the proximate end of the handle. In one embodiment, the diverter 160 extends only partially into the hollow interior cavity 115 of the handle 110. In one embodiment, head 120 comprises two legs 118*a* and 118*b* and one connector 119.

Figure 1D:
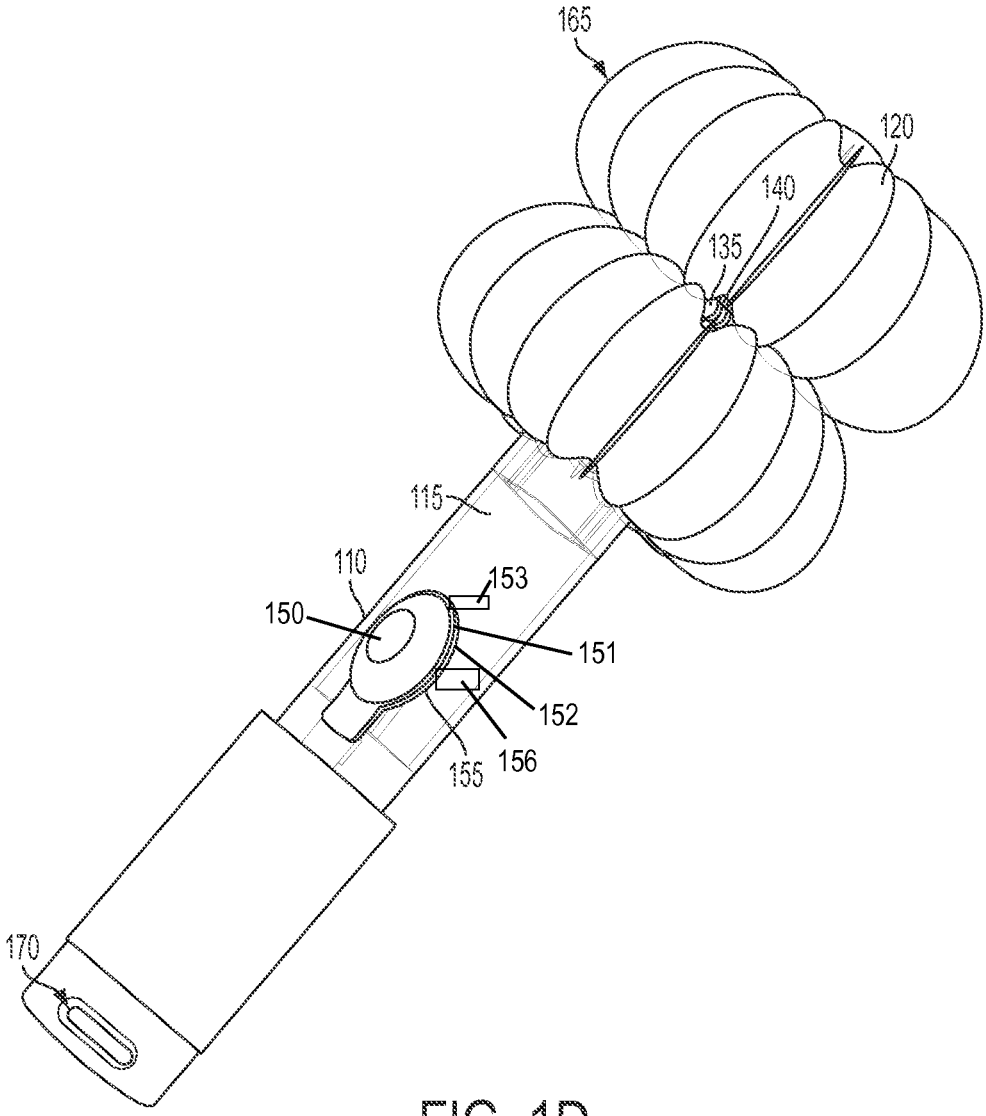
FIG. 1D a body scrub brush according to one embodiment of the invention.

FIG. 1D depicts the body scrub brush 100 of FIG. 1 wherein the head 120 is configured to receive a variety of scrubbing attachments 165, including but not limited to poufs; loofahs; and wash cloths. The handle 110 comprises an opening 170 from which the body scrub brush 100 can be hung when not in use while bathing. In one embodiment, elastomeric button 150 comprises a lip 151 which mates with a shoulder 152 in an opening in the exterior surface of the handle. In one embodiment, elastomeric button 150 comprises a first tab 153 that can be grasped and pulled to remove the elastomeric button 150. In one embodiment, elastomeric button 150 comprises a second tab that attaches elastomeric button 150 to handle 110 so that it cannot be separated from handle 110.

Figure 2A:
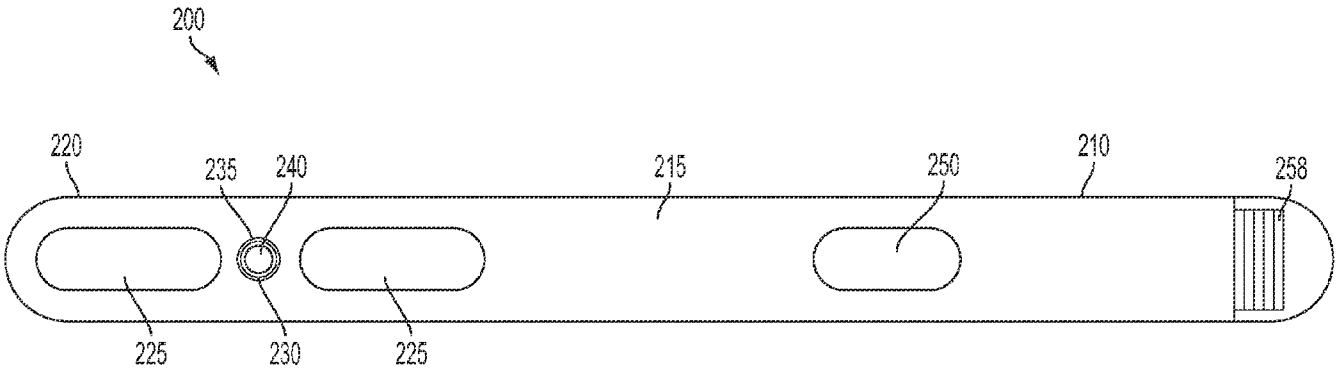
FIG. 2A depicts a top view of a body scrub brush according to one embodiment of the invention.

FIG. 2A depicts a body scrub brush according to another embodiment of the invention. Body scrub brush 200 comprises a handle 210 having a hollow interior cavity 215 configured for containing liquid soap (not shown); a head 220 comprising a scrubbing attachment receiver 225; and an elastomeric button 250 situated on the handle 210 that is configured to pump liquid soap (not shown) through the channel and through the outlet holes 230. In this embodiment, body scrub brush 200 further comprises a cap 258 disposed on the distal end of handle 210. Body scrub brush 200 comprises a hollow interior 215 wherein the cross sectional surface area of the hollow interior 215 proximate the elastomeric button 250 is narrower than the cross sectional surface area of the hollow interior 215 of the handle 210 at either the proximal end or the distal end of the handle 210. Cap 258 is removable so that liquid soap can be poured into hollow interior cavity 215. Elastomeric button 250 may also be removable to allow for introduction of liquid soap into hollow interior cavity 215.

Figure 2B:
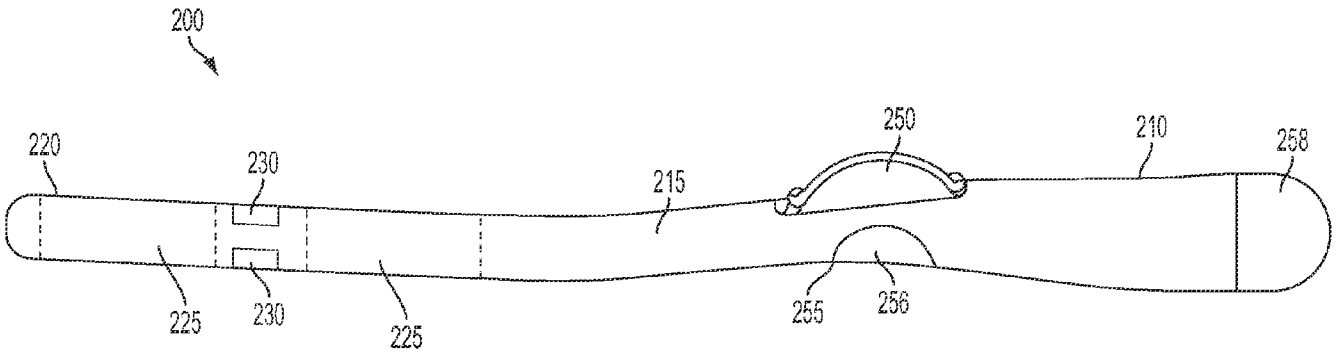
FIG. 2B depicts a side view of the body scrub brush of FIG. 2A.

FIG. 2B depicts a side view of the body scrub brush of FIG. 2A. As seen in this view, body scrub brush 200 further comprises an outlet hole 255 and a stopper 256 opposite the elastomeric button 250. Stopper 256 provides a flexible surface in handle 210 to reduce the formation of a vacuum effect inside hollow interior cavity 215 when elastomeric button 250 is pressed, thus reducing the likelihood of elastomeric button 250 caving into hollow interior cavity 215 and/or dislodging from handle 210.

Figure 2C:
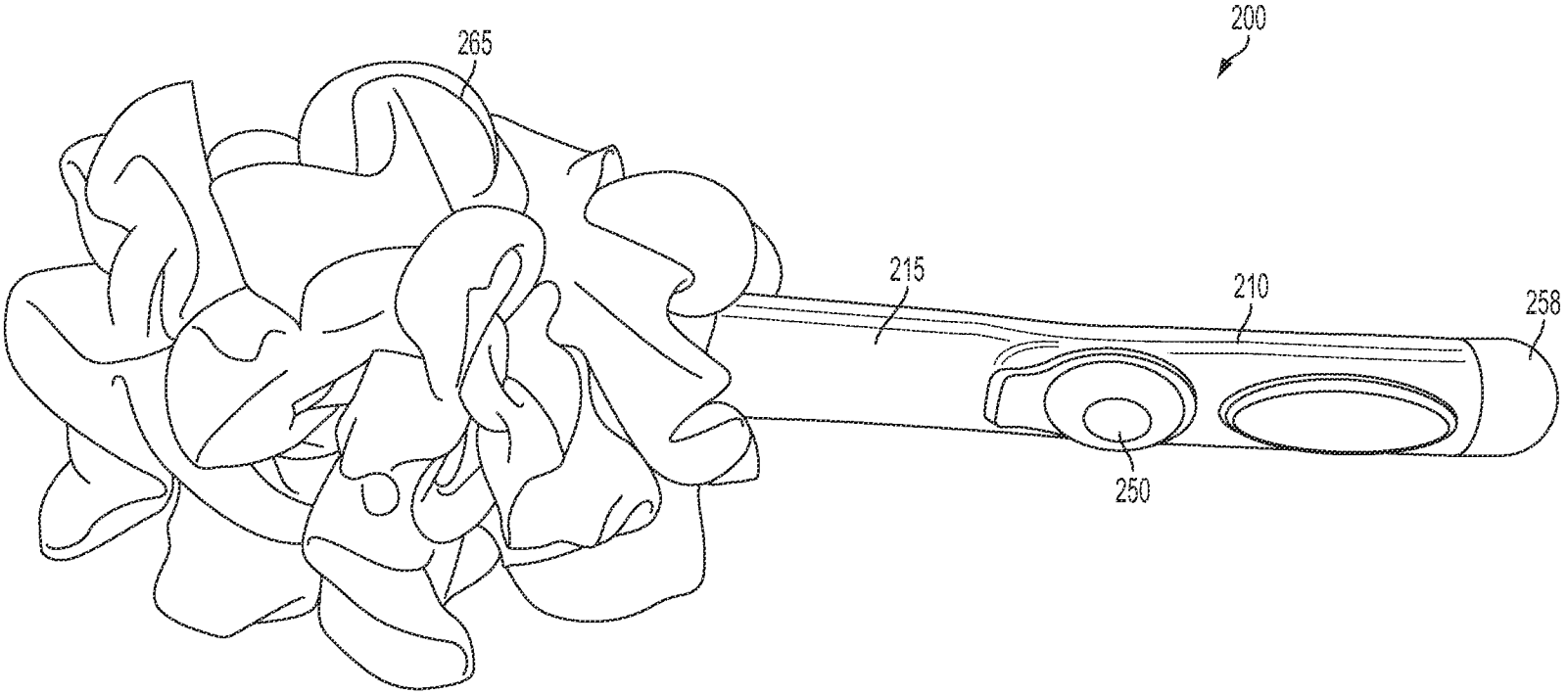
FIG. 2C depicts a top perspective view of the body scrub brush of FIG. 2A.

FIG. 2C depicts a top perspective view of the body scrub brush of FIG. 2A. As seen in this view, body scrub brush 200 comprises a scrubbing attachment 265, which may comprise a pouf; a loofah; and a wash cloth.

Figure 2D:
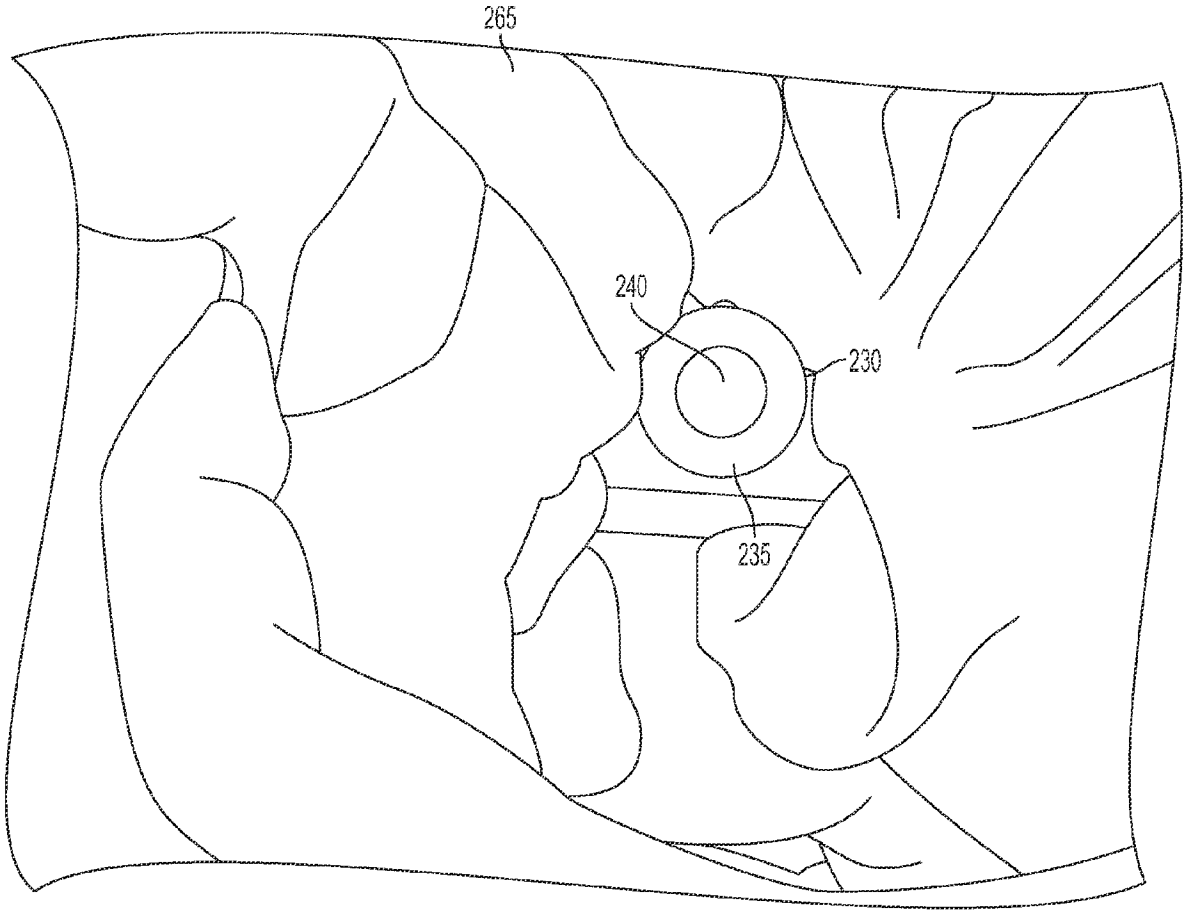
FIG. 2D depicts the valve in the head of the body scrub brush of FIG. 2A.

FIG. 2D depicts the valve in the head of the body scrub brush of FIG. 2A. As seen in this view, head 220 further comprises one or more outlet holes 230, located substantially in the center of the scrubbing attachment 265, where each outlet hole 230, is sealed with an elastomeric seal 235 having at least one orifice 240. A channel (not shown) extends between the hollow interior cavity 215 of the handle 210 and each outlet hole 230, such that placing force on elastomeric button 250 situated on the handle 210 pumps liquid soap (not shown) through the channel and through the outlet holes 230.

Figure 3A:
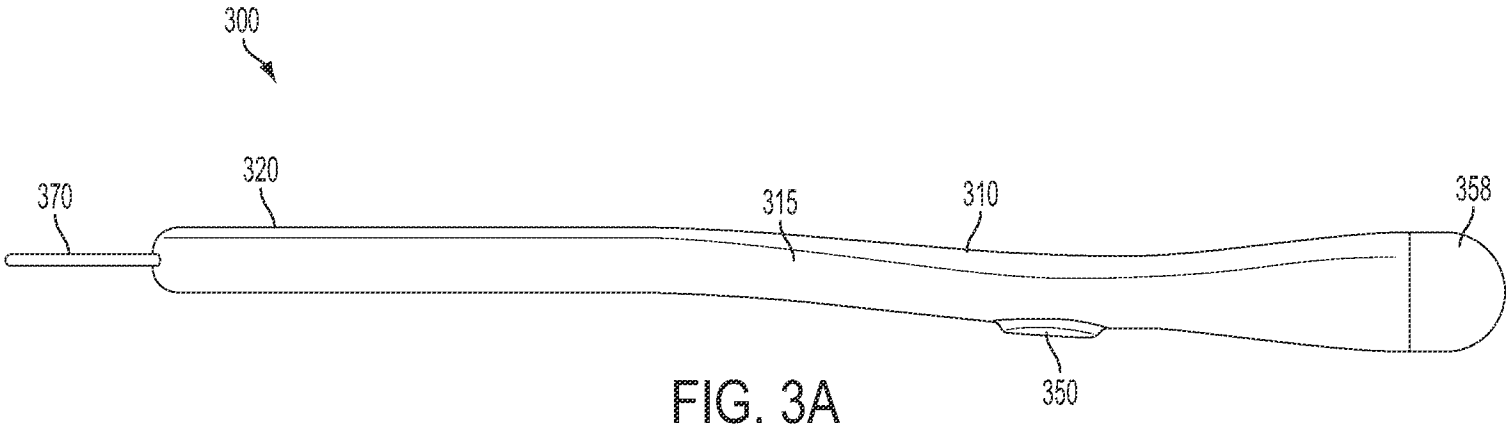
FIG. 3A depicts a side view of a body scrub brush according to one embodiment of the invention.

FIG. 3A depicts a side view of a body scrub brush according to one embodiment of the invention. Body scrub brush 300 comprises a handle 310; a head 320; an elastomeric button 350 situated on the handle 310; a cap 358; and a hook 370 from which the body scrub brush 300 can be hung when not in use while bathing.

Figure 3B:
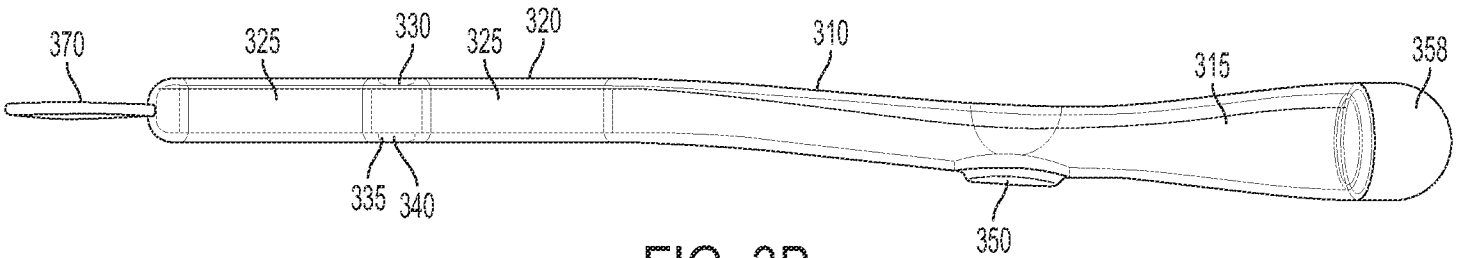
FIG. 3B depicts the interior of the body scrub brush of FIG. 3A.

FIG. 3B depicts the interior of the body scrub brush of FIG. 3A. Handle 310 comprises a head 320 comprising a scrubbing attachment receiver 325 wherein the head 320 further comprises one or more outlet holes 330, located substantially in the center of the scrubbing attachment receiver 325, where each outlet hole 330, is sealed with an elastomeric seal 335 having at least one orifice 340.

Figure 3C:
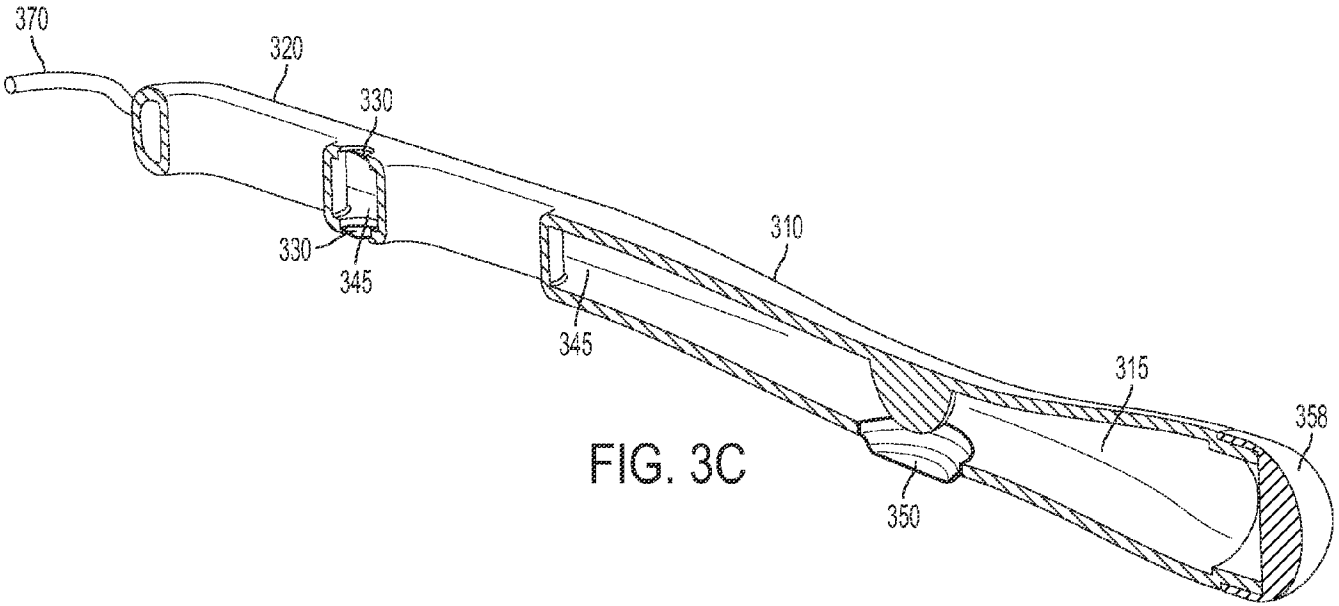
FIG. 3C depicts a cut-away view of the body scrub brush of FIG. 3A.

FIG. 3C depicts a cut-away view of the body scrub brush of FIG. 3A. As seen in this view, head 320 further comprises a channel 345 between the hollow interior cavity 315 of the handle 310 and each outlet hole 330; and an elastomeric button 350 situated on the handle 310 that is configured to pump liquid soap (not shown) through the channel 345 and through the outlet holes 330.

Figure 4A:
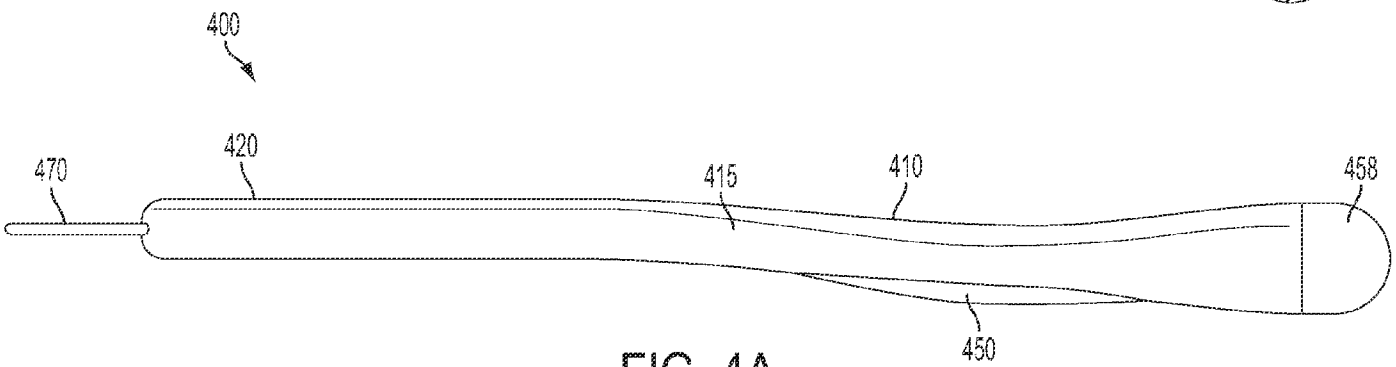
FIG. 4A depicts a side view of a body scrub brush according to one embodiment of the invention.

FIG. 4A depicts a side view of a body scrub brush according to one embodiment of the invention. Body scrub brush 400 comprises a handle 410; a head 420; an elastomeric button 450 situated on the handle 410; a cap 458; and a hook 470 from which the body scrub brush 400 can be hung when not in use while bathing.

Figure 4B:
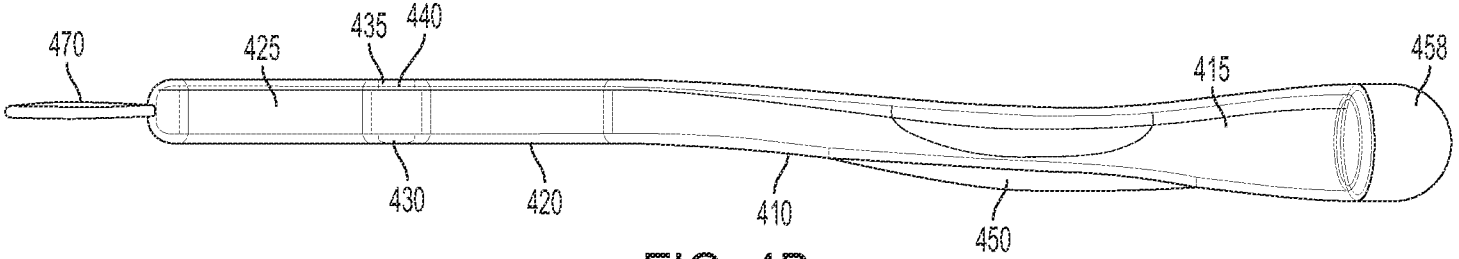
FIG. 4B depicts the interior of the body scrub brush of FIG. 4A.

FIG. 4B depicts the interior of the body scrub brush of FIG. 4A. Handle 410 comprises a head 420 comprising a scrubbing attachment receiver 425 wherein the head 420 further comprises one or more outlet holes 430, located substantially in the center of the scrubbing attachment receiver 425, where each outlet hole 430, is sealed with an elastomeric seal 435 having at least one orifice 440.

Figure 4C:
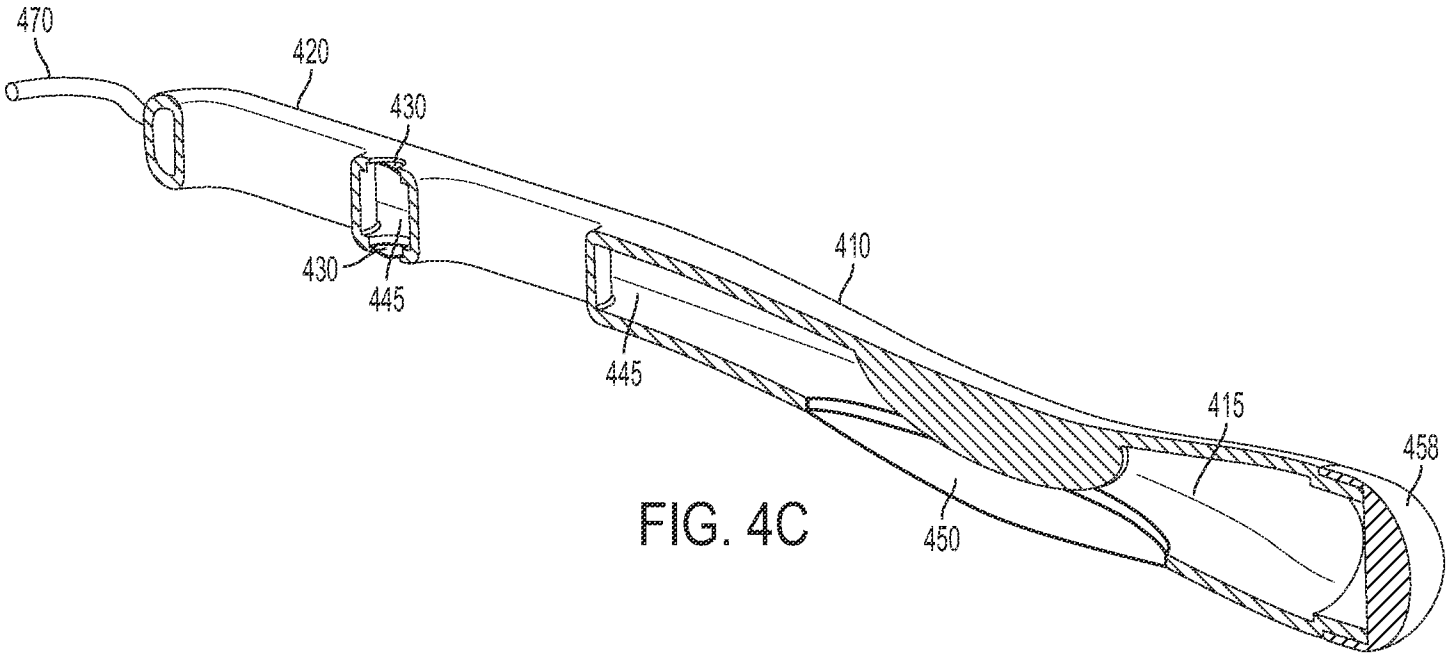
FIG. 4C depicts a cut-away view of the body scrub brush of FIG. 4A.

FIG. 4C depicts a cut-away view of the body scrub brush of FIG. 4A. As seen in this view, head 420 further comprises a channel 345 between the hollow interior cavity 415 of the handle 410 and each outlet hole 430; and an elastomeric button 450 situated on the handle 410 that is configured to pump liquid soap (not shown) through the channel 445 and through the outlet holes 430.

The foregoing embodiments have been presented for the purpose of illustration and description only and are not to be construed as limiting the scope of the invention in any way. The scope of the invention is to be determined from the claims appended hereto.

What is claimed is:

1. A body scrub brush comprising:

a handle having a first distal end, a first proximal end enclosed by a first top face, wherein the first top face comprises one or more outlet holes, a first front side and a first back side, wherein the distance between the first front side and the first back side comprises the depth of the handle, wherein the handle comprises a first hollow interior cavity configured for containing liquid soap, and a resealable opening through which liquid soap can be transferred into the first hollow interior cavity;

an elastomeric button disposed on the exterior of the handle;

a head comprising a second distal end enclosed by a base face, a second proximal end enclosed by a second top face, a second hollow interior cavity, a second front side and a second back side, a contiguous channel disposed in the second distal end, wherein the contiguous channel comprises two legs and one connector, wherein each leg comprises one open end, wherein further the channel comprises one or more outlet holes disposed between the two legs, wherein each outlet hole comprises an elastomeric seal having at least one orifice, slit, cross-hair slit or other outlet from the channel to the exterior of the head, and one or more scrubbing attachment receivers configured to mate with one or more scrubbing attachments, each having a scrubbing surface; and a diverter disposed in the first hollow interior cavity substantially opposite the elastomeric button, wherein the base face of the second distal end of the head mates to the first top face of the first proximal end of the handle, and each of the two outlets of the legs of the channel mates with one of the outlets that are disposed on the first top face of the first distal end of the handle, wherein further the outlet holes are disposed such that a scrubbing attachment that is disposed in one or more of the scrubbing attachment receivers is located substantially proximate to the orifice, slit, cross-hairs slit or other outlet hole.

2. The body scrub brush of claim 1, wherein the resealable opening comprises an opening having male threads configured to mate with a removable cap comprising female threads.

3. The body scrub brush of claim 1, wherein the elastomeric button is configured to apply pressure to the first hollow interior cavity of the handle when pressed into the first hollow interior cavity.

4. The body scrub brush of claim 3, wherein the elastomeric button comprises a lip which mates with a shoulder in an opening in the exterior surface of the handle.

5. The body scrub brush of claim 4, wherein the elastomeric button comprises the resealable opening.

6. The body scrub brush of claim 5, wherein the elastomeric button comprises a first tab that can be grasped and pulled to remove the elastomeric button from the opening.

7. The body scrub brush of claim 6, wherein the elastomeric button comprises a second tab that attaches the elastomeric button to the handle so that it cannot be separated from the handle.

8. The body scrub brush of claim 1, wherein the diverter comprises a solid exterior partition tapered in width and height from wider to narrower in the direction of the first distal end of the handle to the first proximate end of the handle.

9. The body scrub brush of claim 8, wherein the diverter extends only partially into the first hollow interior cavity of the handle.

10. The body scrub brush of claim 1, wherein the distal end of the handle comprises a shape configured for easy gripping with the hand of a user of the body scrub brush.

11. The body scrub brush of claim 10, wherein the distal end is covered with a surface that is easy to grasp when the handle is wet.

12. The body scrub brush of claim 11, wherein the distal end comprises an opening or hook.

13. The body scrub brush of claim 1, wherein the handle and the head comprise a unitary piece having a single hollow interior cavity comprising the first hollow interior cavity and the second hollow interior cavity, wherein a divider is disposed between the first hollow interior cavity and the second hollow interior cavity, wherein the divider comprises one or more outlet holes that mate with the outlets of the legs of the channel.

14. The body scrub brush of claim 1, wherein the elastomeric seals of the outlet holes are configured to retain a liquid within the channel when the first interior hollow cavity is at atmospheric pressure, but allow liquid to flow from the channel through the orifice, slit, cross-hairs slit or other outlet when the pressure within the interior of the channel is increased above atmospheric pressure.

15. The body scrub brush of claim 1, wherein at least one scrubbing attachment receiver comprises a cavity that passes through the head from the second front side to the second back side.

16. A body scrub brush comprising:

a handle having a first distal end, a first front side and a first back side, wherein the distance between the first front side and the first back side comprises the depth of the handle, wherein the handle comprises a first hollow interior cavity configured for containing liquid soap, and a resealable opening through which liquid soap can be transferred into the first hollow interior cavity;

an elastomeric button disposed on the exterior of the handle;

a head comprising a second distal end enclosed by a base face, a second hollow interior cavity, a second front side and a second back side, and a contiguous channel disposed in the second distal end, wherein the channel comprises one or more outlet holes, wherein each outlet hole comprises an elastomeric seal having at least one orifice, slit, cross-hair slit or other outlet from the channel to the exterior of the head, and one or more scrubbing attachment receivers configured to mate with one or more scrubbing attachments, each having a scrubbing surface; and a diverter disposed in the first hollow interior cavity substantially opposite the elastomeric button, wherein the outlet holes are disposed such that a scrubbing attachment that is disposed in one or more of the scrubbing attachment receivers is located substantially proximate to the orifice, slit, cross-hairs slit or other outlet hole, wherein further the first hollow interior comprising the elastomeric button comprises a narrower cross surface area than the cross sectional surface area of the first hollow interior of the body at either the proximal end or the distal end of the handle.

17. The body scrub brush of claim 16, wherein the elastomeric button is configured to apply pressure to the first hollow interior cavity of the handle when pressed into the first hollow interior cavity.

18. The body scrub brush of claim 17 wherein the cross sectional surface area of the first hollow interior gradually decreases starting from the proximal end of the handle in the direction of the elastomeric button and then gradually increases from the elastomeric button to the distal end of the handle.

19. The body scrub brush of claim 17 wherein the cross sectional surface area of the first hollow interior is substantially constant from the proximal end of the handle to a point substantially proximate the elastomeric button, wherein the cross sectional surface area of the first hollow interior decreases starting from the point substantially proximate the elastomeric button to the distal end of the handle.

* * * * *